United States Patent [19]

Naiman

[11] Patent Number: 4,945,351

[45] Date of Patent: Jul. 31, 1990

[54] TECHNIQUE FOR OPTIMIZING GRAYSCALE CHARACTER DISPLAYS

[75] Inventor: Abraham C. Naiman, Toronto, Canada

[73] Assignee: Hewlett-Packard Company, Palo Alto, Calif.

[21] Appl. No.: 197,420

[22] Filed: May 23, 1988

[51] Int. Cl.[5] ..... G09G 1/14

[52] U.S. Cl. ..... 340/793; 340/728

[58] Field of Search ..... 340/793, 700, 744, 748, 340/728, 724; 358/283

[56] References Cited

U.S. PATENT DOCUMENTS

| | | | |
|---|---|---|---|
| 4,158,200 | 6/1979 | Seitz et al. . | |
| 4,237,457 | 12/1980 | Houldsworth | 340/728 |
| 4,251,755 | 2/1981 | Bryden | 340/793 |
| 4,568,975 | 2/1986 | Harshbarger . | |
| 4,720,705 | 1/1988 | Gupta et al. | 340/724 |
| 4,727,414 | 2/1988 | Ranf et al. | 340/793 |
| 4,760,447 | 7/1988 | Koka et al. . | |

FOREIGN PATENT DOCUMENTS 0105116 4/1984 European Pat. Off. .

OTHER PUBLICATIONS

"Filtering High Quality Text for Display on Raster Scan Devices", *Computer Graphics,* vol. 15, No. 3, Aug. 1981, pp. 7–15.

"Rectangular Convolution for Fast Filtering of Characters", *Computer Graphics,* vol. 21, No. 4, Jul. 1987, pp. 233–242.

"Ultimate Resolution and Non-Gaussian Profiles in CRT Displays", *Proceedings of the SID,* vol. 27, No. 4 (1986), pp. 275–280.

"The Eye as an Optical Instrument", *Handbook for Perception and Human Performance, vol. 1, Sensory Processes and Perception,* Eds. Boff, K. R., 1986, pp. 4.1–4.20.

"The Effects of a Visual Fidelity Criterion on the Encoding of Images", *IEEE Transactions on Information Theory,* vol. 20, No. 4, Jul. 1974, pp. 525–536.

"Optical Quality of the Human Eye", *J. Physial,* 186, 1966, pp. 558–578.

"Modeling the Display and Perceptions of Grayscale Characters", by Naiman et al, 4 pages, *University of Toronto.*

"Ideal Observer Analysis of Visual Discrimination", *National Academy of Science,* 1987, pp. 17–31.

J. E. Warnock, "The Display of Characters Using Gray Level Sample Arrays", Computer Graphics, vol. 14, No. 3, pp. 302–307, (Jul. 1980).

*IBM Technical Disclosure Bulletin,* "Test Patterns for Human Factors Evaluation of Graphics Quality of Monitors", vol. 28, No. 4, pp. 1521–1526 (Sep.. 4, 1985).

J. H. Wood et al., "New Developments in Electronic Character Generation", SMPTE Journal, vol. 95, No. 5, Part I, pp. 557–561, (May 1986).

E. Catmull, "A Tutorial on Compensation Tables", Computer Graphics, vol. 13, No. 2, Aug. 1979, pp. 1–7.

J. Warnock, "The Display of Characters Using Gray Level Sample Arrays", Computer Graphics, vol. 14, No. 3, Jul. 1980, pp. 302–307.

W. Cowan, "An Inexpensive Scheme for Calibration of a Colour Monitor in Terms of CIE Standard Coordinates", Computer Graphics, vol. 17, No. 3, Jul. 1983, pp. 315–321.

*Primary Examiner*—Jeffery A. Brier

[57] ABSTRACT

Appropriate luminance linearization values are determined for improving sub-pixel positioning of image edges in grayscale displays. Individual display devices may be calibrated by and end-user, or factory luminance linearization settings may be determined. Grayscale characters may be optimized for specific display devices.

20 Claims, 12 Drawing Sheets

TECHNIQUE FOR OPTIMIZING GRAYSCALE CHARACTER DISPLAYS

BACKGROUND OF THE INVENTION

The present invention relates to a technique for determining appropriate luminance linearization of gray levels for sub-pixel positioning tasks. Additionally, the present invention relates to a technique for optimizing grayscale characters for specific display devices.

Traditional characters are analog in nature, their shapes defined by smoothly-varying boundaries. With the advent of raster-scan displays and printers, the analog letterforms—produced by optical and mechanical methods—have been replaced with digital representations which can only approximate their predecessors. This will always be the case since character edges have frequencies of infinite magnitude that can never be exactly reproduced with discrete devices. On the other hand, since the visual system is band-limited, it is only necessary to match the quality of the transmitter (i.e., the display device) to the capabilities of the receiver (i.e., the visual system). Unfortunately, the available resolution of most current display devices pale in comparison to the resolving power of the visual system. Furthermore, pixel point spread functions in display devices usually differ substantially from the ideal reconstruction kernel (i.e., the sync function).

An alternative to higher resolution is the use of grayscale technology, where in addition to black and white pixels, a multitude of gray levels are realizable. In general, if each pixel is represented with n bits, $2^n$ different grayscales are available to each pixel (subject to possible limitations of the display technology). Using gray pixels at the edges of characters can achieve a more faithful representation of the master character than any bi-level version could on the same grayscale device.

Until recently, most text on raster displays used characters represented as binary matrices, the ones and zeros corresponding to the black and white dots to be displayed. Typically, only one set of characters was provided, simple and tuned to the characteristics of the display. Lately, grayscale technology has allowed the incorporation of gray pixels in the character description, leading to a perceived quality improvement when comparing the discrete version of a character with its analog predecessor. With the advent of higher-resolution bi-level displays as well as grayscale devices, there is more flexibility in font sizes and styles which are achievable, but techniques still need to be developed to aid in the production and evaluation of such fonts.

Numerous factors contribute to the perceived quality of digital characters displayed on raster-scan devices such as cathode ray tubes. Due to the characteristic differences between the various display technologies, it is not possible to design a single set of characters that will have acceptable image quality on all devices. Quite often, the only approach to manufacturing suitable character sets for a particular display device is to have a font designer iteratively modify the characters' bitmaps and evaluate them on the screen, until the satisfactory results are obtained. In order to replicate the success of those character matrices, the same type of display must be used and under similar viewing conditions.

Standard filtering techniques are commonly used to generate a grayscale character. In this manner, a high-resolution bi-level master character is convolved with a digital filter and sampled to yield lower-resolution grayscale character. A typical grayscale video display system is disclosed, for example, in U.S. Pat. No. 4,158,200 issued June 12, 1979 to Seitz et al. Other examples of grayscale generation are discussed in Warnock, "The Display of Characters Using Gray Level Sample Arrays," *Computer Graphics*, Vol. 14, No. 3, July 1980, pp. 302–307, and in Kajiya et al, "Filtering High Quality Text for Display on Raster Scan Devices," *Computer Graphics*, Vol. 15, No. 3, Aug. 1981, pp. 7–15. These references are incorporated herein by reference.

For a particular grayscale display, the spatial resolution and number of intensity levels available is predetermined for the grayscale character generation process. However, many different filters can be used to generate a character. Furthermore, even with a single filter, different versions of the same character can be generated by shifting the sampling grid of the filtered character relative to the origin of the master.

A technique is needed whereby grayscale linearizations may be tailored to the response of the human visual system to grayscale character displays. Additionally, in order to measure character quality objectively and effectively, font designers need automated tools for both character generation and image-quality evaluation. Although many systems have been developed for generating characters, utilities for evaluating them are sorely lacking. Accordingly, there is a need for systems which may be used to generate and evaluate high-quality grayscale characters.

BRIEF SUMMARY OF THE INVENTION

The present invention provides a method for determining appropriate luminance linearization values for sub-pixel edge placement in a grayscale display device. A first bipartite field having a white portion and a black portion separated by a sharp transition line is displayed on a first area of a display device. A second field having a white portion and a black portion separated by an intermediate gray strip is displayed on a second area of the display device adjacent the first area. The gray strip is substantially parallel with the sharp transition line separating the black and white portions of the first field and has a height which is determined by the desired sub-pixel edge placement.

A viewer is positioned at a distance from the display calculated from the height of the gray strip and a predetermined visual angle, and the grayscale setting of the gray strip is varied. The grayscale setting which minimizes apparent line discontinuities between the interface of black and white portions of the first and second fields is selected, and a luminance linearization value is set in accordance with the selection.

The predetermined visual angle may be obtained by placing an observer at various arbitrary distances from the display device and varying the grayscale settings. The distance at which the fewest number of grayscale settings provides no apparent line discontinuities is determined. This distance and the height of the gray strip then determine the desired visual angle.

The response of a plurality of viewers may be measured so that an average response may be calculated. This average response is useful for determining appropriate factory settings for luminance linearization values.

BRIEF DESCRIPTION OF THE DRAWINGS

The objects, features and advantages of the present invention will become apparent to the skilled artisan from the following detailed description of the preferred embodiment, when read in view of the accompanying drawings, in which.

DETAILED DESCRIPTION OF THE PREFERRED EMBODIMENTS

Figure 1:
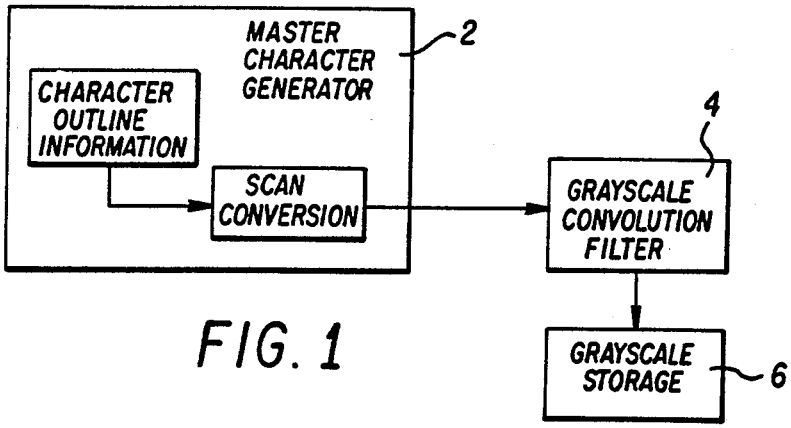
FIG. 1 schematically illustrates a technique for generating grayscale character images from a master character.

A technique for generating grayscale character images is illustrated schematically in FIG. 1. Briefly, the technique utilizes a conventional master character generator 2 to provide a bi-level representation of a master character. The master character generator may operate in a conventional manner to generate high-resolution master characters. Preferably, the outline around a particular character defined by a parametric function is scan converted to produce a high precision bit matrix representation. Of course, other well-known techniques of master character generation such as imaging and various analytic methods are also available.

A digital signal output from the master character generator 2 is input to a grayscale convolution filter 4. The grayscale convolution filter 4 operates in a conventional manner to produce grayscale character images which may be stored in a grayscale character memory 6 for future use.

Figure 2:
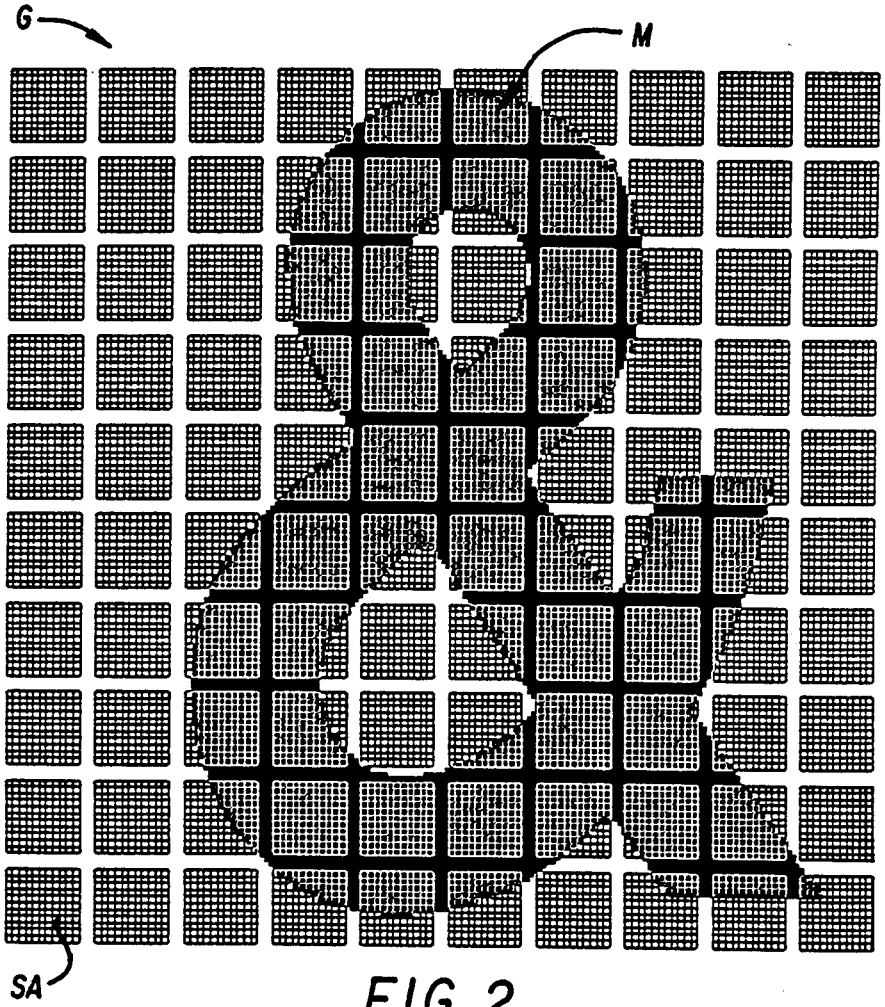
FIG. 2 illustrates a sampling grid used by the grayscale convolution filter of FIG. 1 for generating grayscale character images.

The grayscale convolution filter 4 may compute an appropriate pixel intensity setting by weighting contributions from an area of the master character centered on the pixel. Referring now to FIG. 2, a high-resolution bi-level master character M is overlaid with a sampling grid G. The grid G comprises an array of sampling areas SA which may be centered on pixels in a character display matrix. Each sampling area SA further includes an array of individual samples.

In operation, the convolution filter 4 may compute pixel intensity values by weighting intensity contributions from the individual samples within the sampling area SA. The weighted sum of the intensity contributions from the area centered on the pixel whose value is to be determined is rounded to the nearest of the possible pixel intensity settings.

Figure 3A:
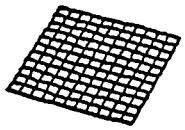
FIGS. 3A–3E graphically illustrate various weighting schemes that may be used in calculating pixel luminance values for a grayscale character image.
Figure 3B:
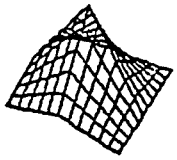
Figure 3C:
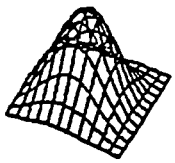
Figure 3D:
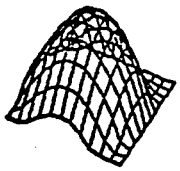
Figure 3E:
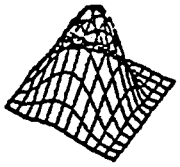

One simple weighting scheme is to equally weight the intensity contribution by each sample within the sampling area. Samples from outside the sampling area are given zero weight. This weighting scheme is illustrated graphically in FIG. 3A. Other possible weighting schemes are graphically illustrated in FIGS. 3B–3E. For example, in the weighting scheme illustrated in FIG. 3B, samples from the central portion of the sampling area are given greater weight than outlying samples. Samples from beyond the sampling area are, again, given no weight. The filters illustrated in FIGS. 3B and 3C appear in the aforementioned Warnock paper. FIG. 3D illustrates a two-dimensional radially symmetric sinusoidal filter, and FIG. 3E illustrates a two-dimensional radially symmetric gaussian filter. Although each illustrated filter is symmetrical, asymmetrical filters may be used in appropriate settings, and in fact need not be generated analytically. The grayscale character images generated by the grayscale convolution filter 4 will, of course, depend upon the particular filtering scheme which is used.

Figure 4:
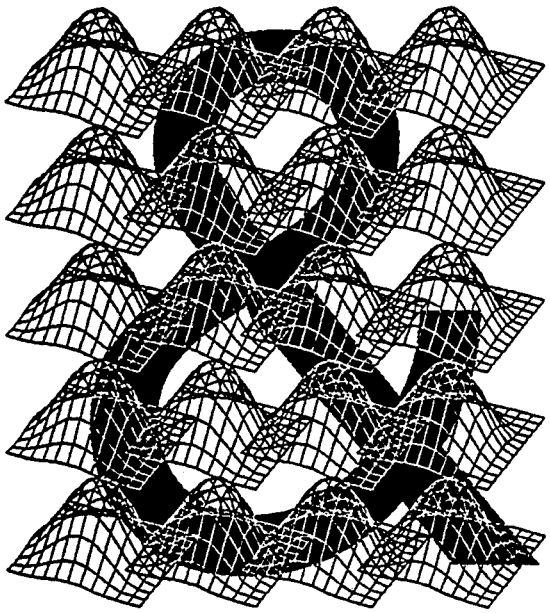
FIG. 4 schematically illustrates a sampling grid including overlapping sampling areas.
Figure 5:
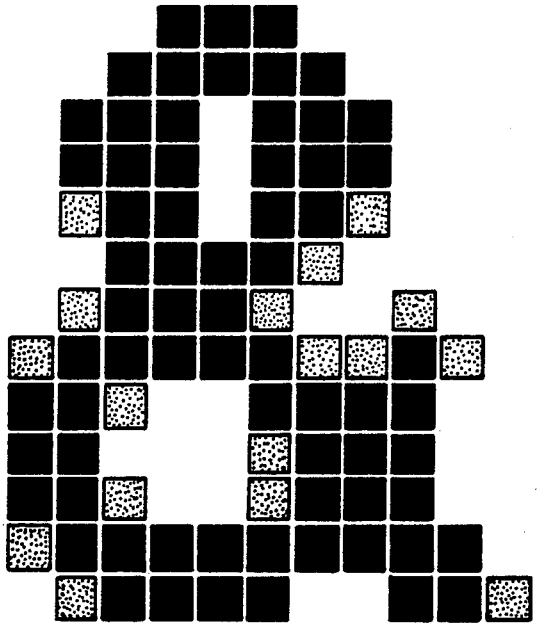
FIG. 5 shows a grayscale character image produced by filtering in accordance with the sampling grid of FIG. 4.

Although the individual sampling areas SA of FIG. 2 do not overlap, actual sampling grids will usually include overlapping sampling areas as illustrated in FIG. 4. FIG. 5 illustrates a computed grayscale character image resulting from filtering the master character in accordance with the sampling grid represented schematically in FIG. 4. It will be appreciated that the number of sampling areas illustrated in FIG. 4 is reduced for purposes of illustration.

Figure 6A:
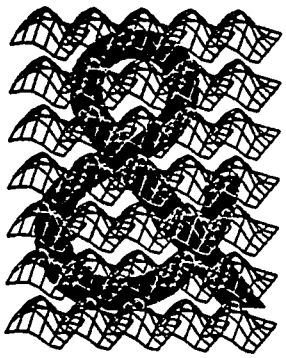
FIGS. 6A and 6B illustrate a grayscale character image produced in accordance with a particular sampling grid.
Figure 6B:
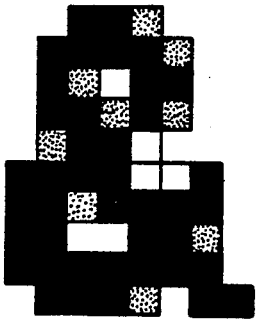
Figure 7A:
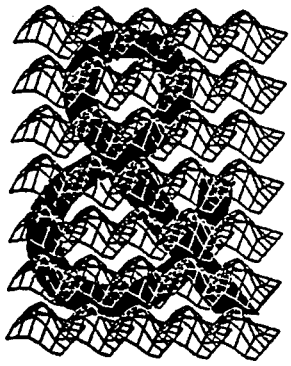
FIGS. 7A and 7B are similar to FIGS. 6A and 6B, respectively, and illustrate a grayscale character image produced in accordance with a sampling grid which is shifted with respect to a master character.
Figure 7B:
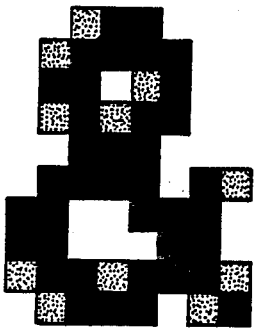

The position of the sampling grid with respect to the master character will also affect the computed grayscale character image. FIGS. 6A and 6B schematically illustrate a sampling grid and the resultant grayscale image, respectively. FIGS. 7A and 7B schematically illustrate a grayscale image computed from the sampling grid of FIG. 6A which is shifted with respect to the master character. As can be seen from a comparison of FIGS. 6B and 7B, the computed grayscale image is clearly affected by sampling grid position. Orientation of the sampling grid will likewise affect the computed grayscale image.

Figure 8:
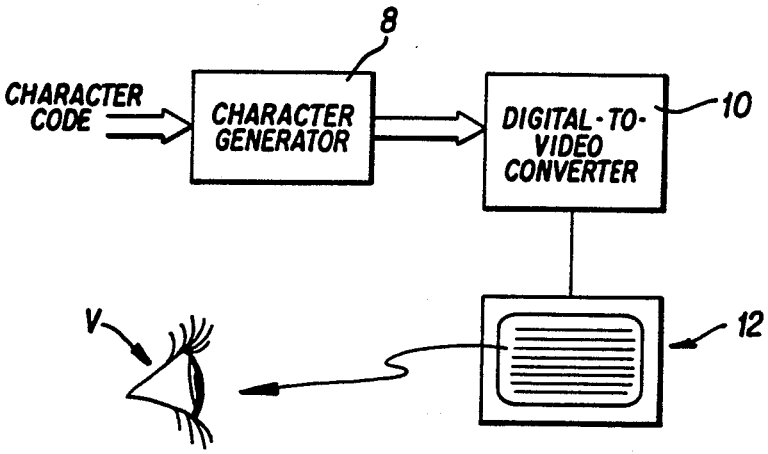
FIG. 8 illustrates a gray scale character display system.

Turning to FIG. 8, one conventional manner of displaying grayscale image patterns will now be described. This description is, of course, merely exemplary. The skilled practitioner will appreciate that alternate schemes are available.

A character generator 8 may receive a character code from a microprocessor (not shown) or the like. The character code may be processed by the character generator 8 to obtain an address value. This address value is then used as a look-up value in a character font memory wherein grayscale character information is stored. Alternatively, the grayscale character information may be calculated in real time by the character generator directly from the master character information. Such a technique is discussed in Naiman et al, "Rectangular Convolution for Fast Filtering of Characters," *Computer Graphics,* Vol. 21, No. 4, July 1987, pp. 233–242, which is hereby incorporated by reference.

The character generator 8 preferably generates a serial stream of digital image point values corresponding to the grayscale intensity settings. Of course, in appropriate systems, a parallel image point signal may be used. The serial stream of image point intensity setting values from the character generator 8 is supplied to a digital-to-video converter 10 which converts the digital stream to an analog video signal. The analog video signal would of course include an appropriate horizontal synchronization rate and vertical blanking interval. The analog video signal, in turn, controls a display device 12 which displays grayscale characters in response to the analog video signal. The grayscale character may then be observed by a viewer V.

As is well known in the art, the relationship between pixel intensity settings and the luminance values actually realized on a display device is nonlinear. Several techniques have been developed for compensating for luminance non-linearities. Examples of such techniques are described in Catmull, "A Tutorial on Compensation Tables," *Computer Graphics,* Vol. 13, No. 2, Aug. 1979, pp. 1–7, and in Cowan, "An Inexpensive Scheme for Calibration of a Colour Monitor in Terms of CIE Standard Coordinates," *Computer Graphics,* Vol. 17, No. 3, July 1983, pp. 315–321.

Although recent indications suggest that a single compensation table may be inadequate for the entire display surface, it is usually adequate for any localized area. Accordingly, a linearization table may be provided between the character generator 8 and the digital-to-video converter 10 to compensate for nonlinearities in display device luminance. The luminance produced on a display surface is also somewhat dependent on adjacent pixel settings. Additional factors such as shadow mask interference (in color monitors) may also affect pixel luminance.

For each pixel, an area on the screen is illuminated, wherein the intensity profile, also known as the point spread function, is centered on the pixel location and decreases monotonically from the center. Modelling a pixel point spread is somewhat difficult. Fortunately, the spectral power distribution of screen phosphors is invariant over emission levels, and the intensity profile is scale invariant, i.e., the intensity profile maintains its shape at different settings, module a multiplicative factor. Difficulties arise, however, due to the fact that the intensity profile is spatially variant, i.e., it may have a different shape in a different portion of the display. Furthermore, pixel point spread functions are designed to overlap with those of neighboring pixels and, thus, the intensity profile may not be spatially independent.

Typically, a single point spread function will be determined as a general description of the point spread at all portions of the screen.

Figure 9:
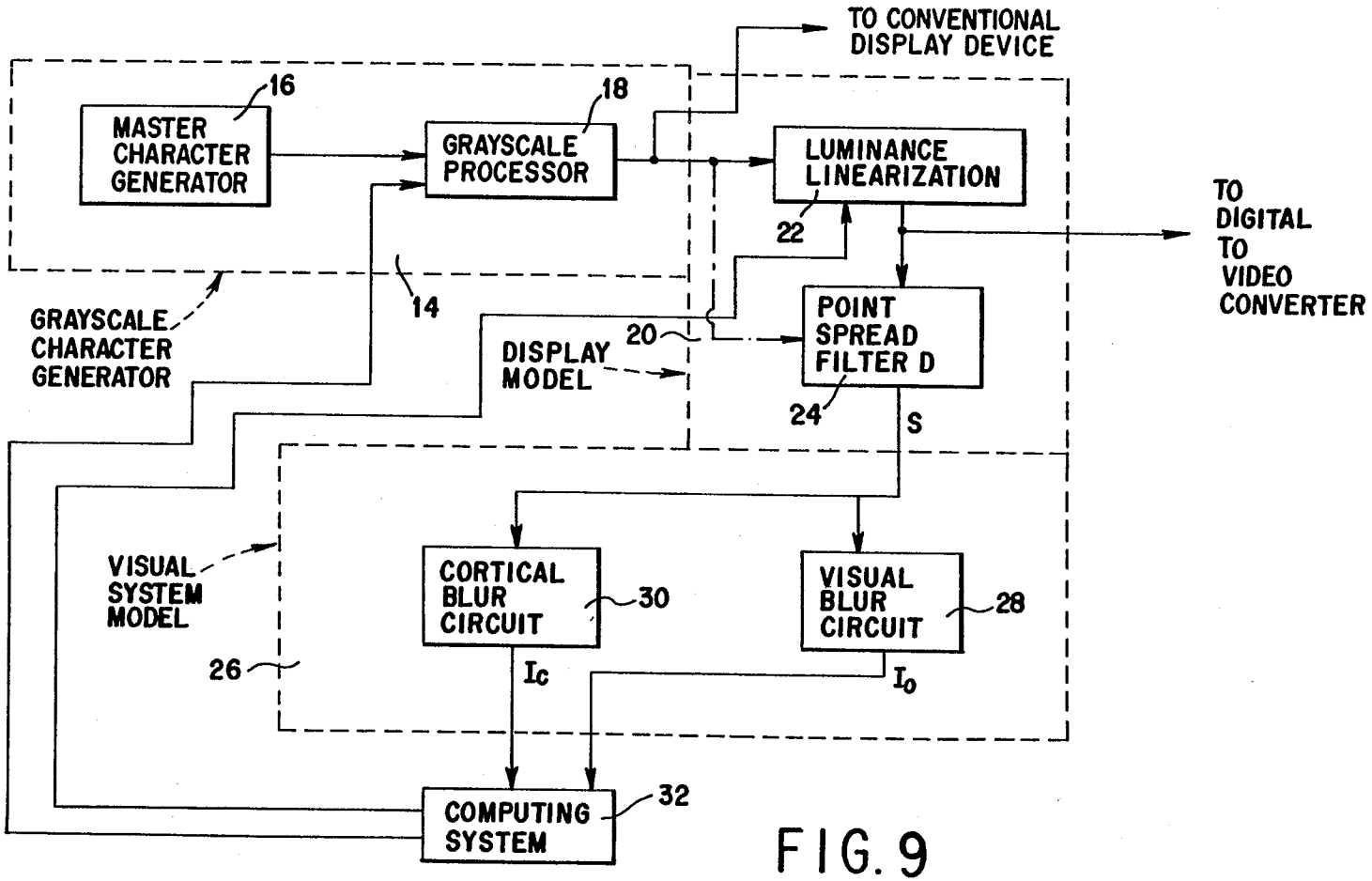
FIG. 9 illustrates a system for modelling the generation, display, and observation of a gray scale character image.

FIG. 9 illustrates a system for modelling the generation, display, and observation of grayscale character images. A grayscale character generator 14 includes a master character generator 16 which provides a series of digitized signals representative of the master character. These digitized signals are supplied to a grayscale processor 18 for grayscale filtering and resampling in the manner discussed above. Accordingly, the output of the grayscale processor 18, and thus the output of grayscale character generator 14, is a set of pixel intensity settings corresponding to the computed grayscale values.

The pixel intensity settings are supplied to a display model 20. Preferably, the display model includes a luminance linearization circuit 22 and a point spread filter 24 connected in series. In order to obtain an indication of the light pattern on a display surface when a grayscale character is presented, a luminance linearization function L is implemented in the luminance linearization circuit 22. The output of the linearization circuit 22 is then convolved with the pixel point spread function.

The luminance linearization function L tailors the intensity setting request from the grayscale processor to the physical characteristics of a particular display device. In a display model, however, it is possible to assume that the request of the grayscale processor was actually met by the display device. Accordingly, the point spread filter may be applied directly to the output of the grayscale processor, as indicated in FIG. 9. Of course, the linearization function must be applied before sending the intensity request to the screen of an actual display device.

For simplicity, it may be assumed that pixel luminance is spatially invariant with respect to position on the CRT screen and is independent of adjacent pixel settings. In other words, an assumption may be made that actual pixel luminance depends only upon the intensity setting and is independent of the particular pixel position on the screen and the intensity setting of adjacent pixels.

Figure 10A:
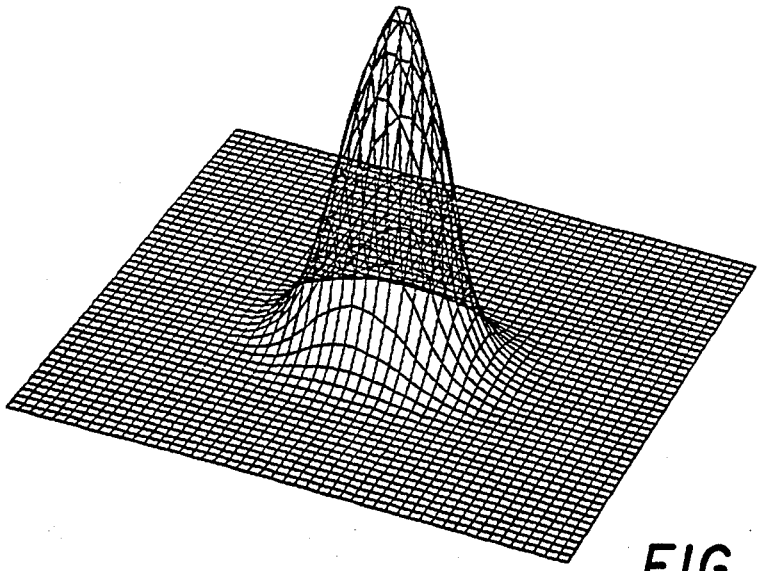
FIGS. 10A and 10B graphically illustrate pixel point spread functions used in the system of FIG. 9.
Figure 10B:
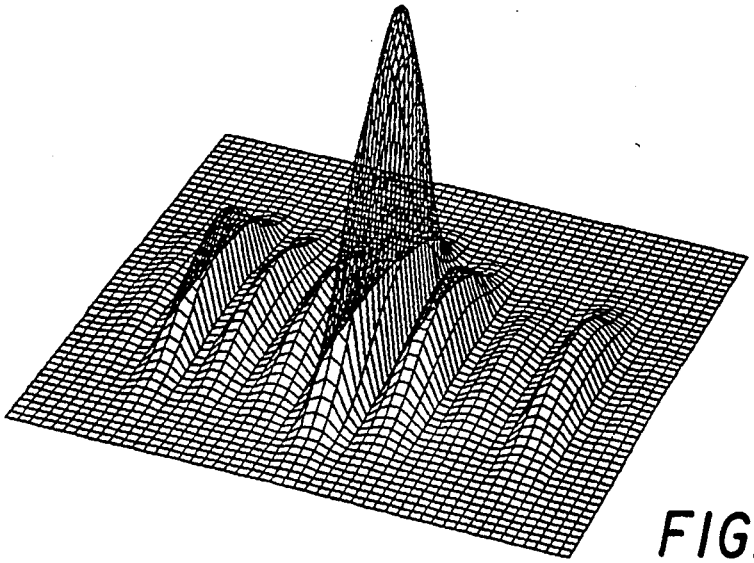

The linearized gray scale image is convolved with the pixel point spread function by the point spread filter 24 to produce a signal S which is representative of the light stimulus coming from the display device. A pixel point spread function for a typical monochrome gray scale display device is graphically illustrated in FIG. 10A. FIG. 10B illustrates the point spread function for one type of color monitor displaying a white pixel. Of course, other color monitors would include different pixel point spread functions.

Typically, a single point spread function may be determined which generally characterizes the entire display. It is also possible, however, to determine different point spread functions for various portions of the screen. Of course, in the limit, separate point spread functions may be determined for each pixel on the display device, and functional relationships between adjacent pixels may be developed.

By specifying the resolution at which the point spread function is measured or, alternatively, by using an analytic representation of the pixel point spread function, the precision at which the stimulus signal S is given can be controlled. Analytic representations of pixel point spread functions are discussed, for example, in Infante, "Ultimate Resolution and Non-Gaussian Profiles in CRT Displays," *Proceedings of the SID,* Vol. 27, No. 4 (1986), pp. 275–280.

Once a useful representation of a character displayed on a gray scale device is obtained, it is desired to determine what a typical human eye would actually observe in terms of the pattern imaged on the retina when viewed from a given distance. Additionally, it is desired to determine how a typical human visual system responds to the stimulus in terms of sensitivity to the incoming frequencies. The former relates to the optics of the ocular media, whereas the latter relates to psychophysical measurements of cortical image processing.

Accordingly, the stimulus signal S is supplied to a visual system model 26. The visual system model 26 includes an optical blur function circuit 28 which models the optical aspects of the visual system. The optical blur function $V_o$, or optical point spread, describes how a point light source is imaged onto the retina, in terms of visual angle. As is well known in the art, visual angle is the angular subtense of an image measured at the retina. Although an appropriate optical blur function depends on the diameter of the pupil and the spectral power of the light, a single optical blur function suffices for monochromatic, broadband light sources, when the eye is in good focus and has a pupil diameter of 2 mm. See Westheimer, G., "The Eye as an Optical Instrument," *Handbook for Perception and Human Performance,* Vol. 1, *Sensory Processes and Perception,* Eds. Boff, K. R., Kaufman, L., and Thomas, J. P., John Wiley & Sons, 1986, pp. 4.1–4.20.

Figure 11:
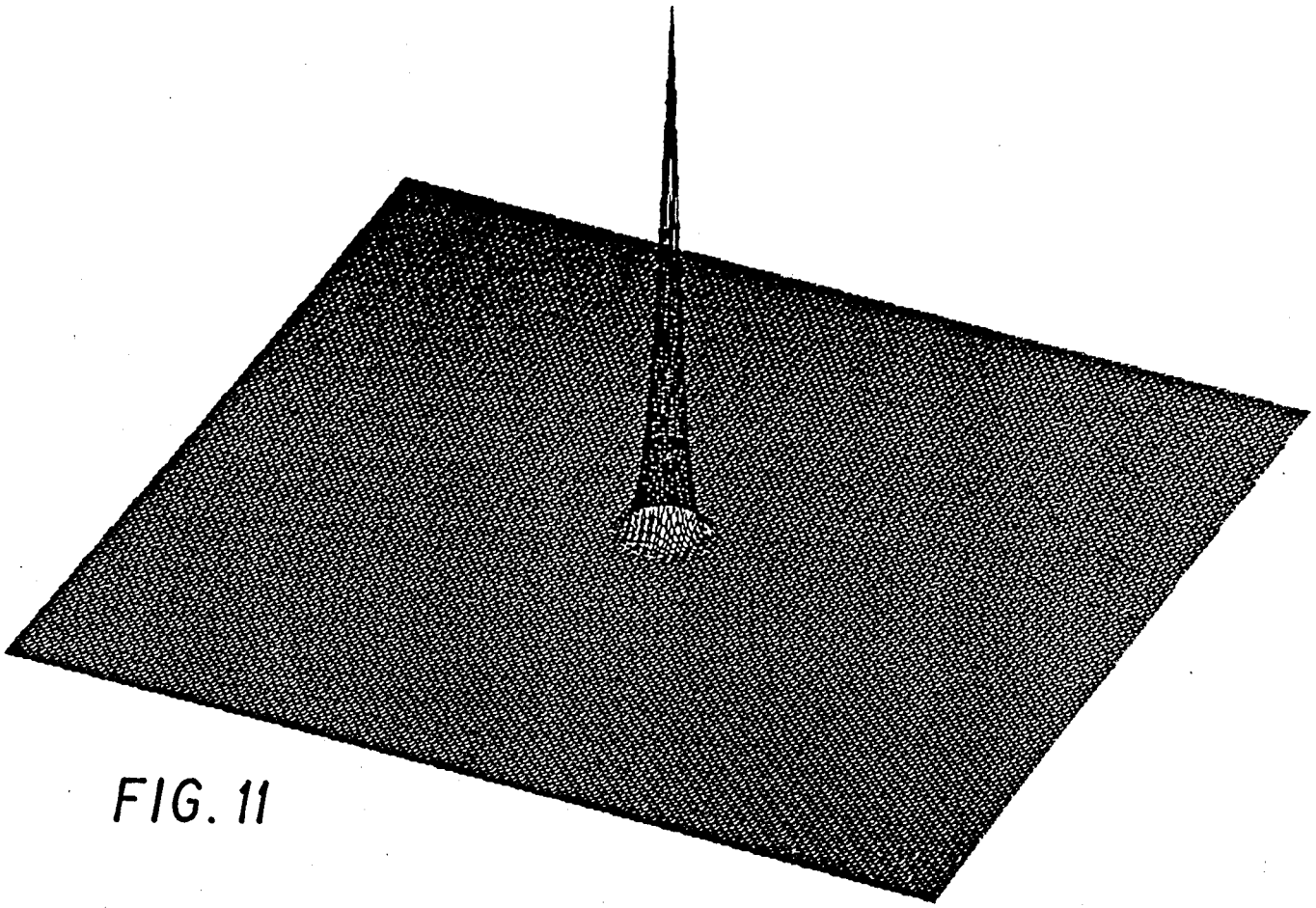
FIG. 11 graphically illustrates an optical blur function used in the system of FIG. 9.

A two-dimensional optical blur function $V_o$ representing the filtering of a point light source passing through the lens of the eye is illustrated in FIG. 11. The dimensions of the grid are 30×30 minutes of arc, and the blur function approaches zero at approximately two minutes of arc from the center. Convolving the stimulus representation S with the optical blur function $V_o$ yields a description of the lens-blurred character image $I_o$ on the retina. Like the pixel point spread function discussed above, error in the character image representation can be controlled by setting the precision at which the optical blur function $V_o$ is defined.

Additional filtering occurs due to photoreceptor sampling and cortical image processing. It is known that the combined effects of optical and psychophysical filtering are captured by the human contrast sensitivity function, which describes the band-pass spatial filtering properties imposed upon every stimulus the visual system encounters. Like optical blur, contrast sensitivity depends on the amount of light entering the eye as well as the temporal frequency of the stimulus S.

Figure 12:
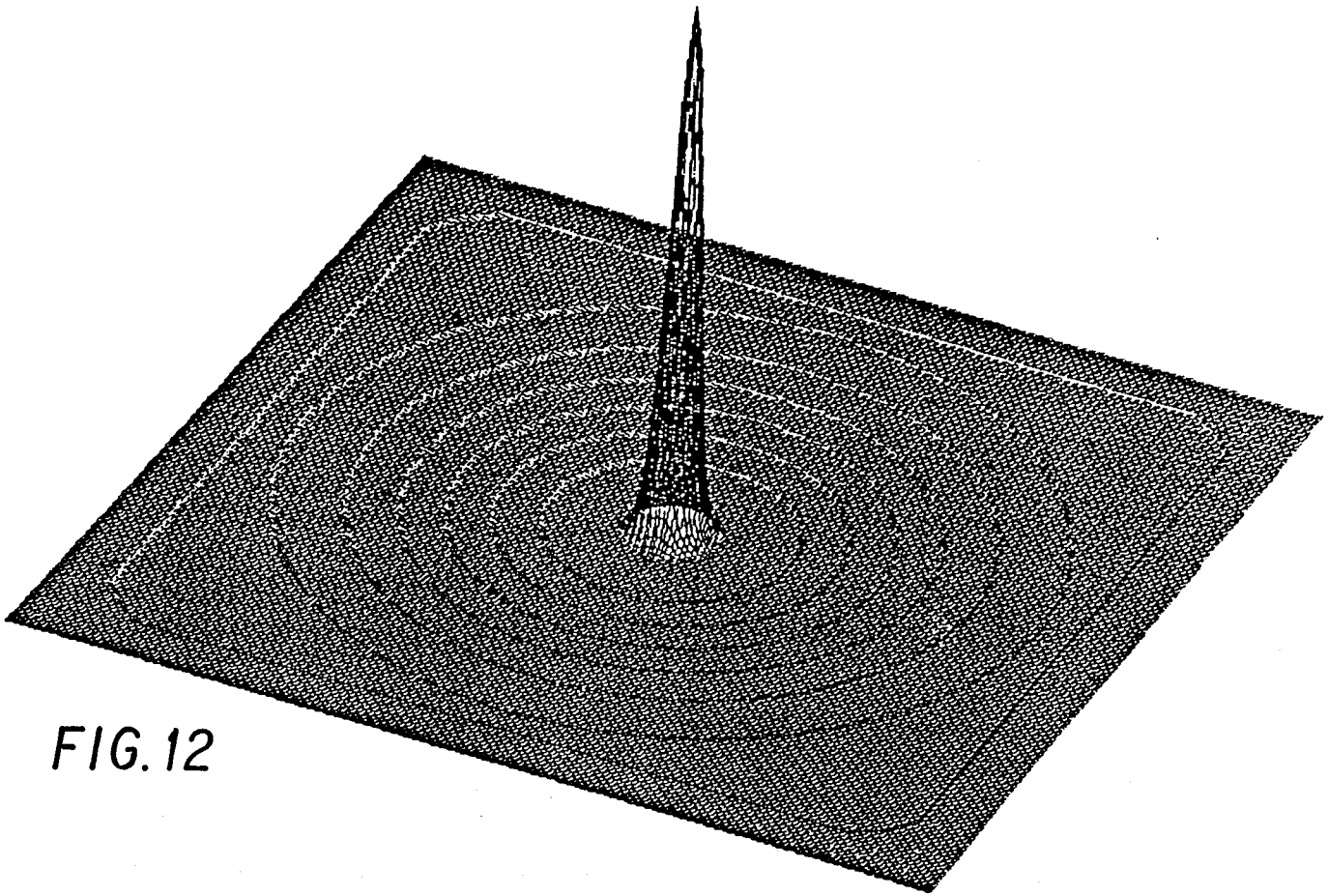
FIG. 12 graphically illustrates a cortical blur function used in the system of FIG. 9.

For a particular contrast sensitivity function, a band-pass point spread function $V_c$ may be derived which, when convolved with the stimulus signal S yields a representation $I_c$ of the image after luminance contrast that the visual system cannot detect has been filtered out. A cortical blur circuit 30 is provided to convolve the stimulus signal S with the cortical blur function $V_c$. A two-dimensional cortical blur function $V_c$ derived from a human contrast sensitivity function is illustrated in FIG. 12. The dimensions of the grid are 30×30 minutes of arc. The cortical blur function $V_c$ becomes negative at approximately five minutes of arc from the center and returns to zero at approximately fifteen minutes of arc.

Given the optical point spread and the contrast sensitivity functions appropriate for the viewing conditions, the visual system response may be represented by convolving the stimulus signal S with filters $V_o$ and $V_c$ to yield signals $I_o$ and $I_c$, which correspond to the images perceived by the visual system, either in terms of the physical mapping of the retina, or the psychophysical response to the stimulus, respectively. Although the illustrated visual system model 26 includes only an optical blur circuit and a cortical blur circuit, additional circuits which model intermediate stages of human visual processing may also be provided.

Turning again to FIG. 9, a computing system 32 receives the signals $I_o$ and/or $I_c$ as inputs. This computing system may be any appropriate system including, for example, a processor and associated circuitry. A feedback control loop is provided between the computing system 32 and the grayscale processor 18, and between the computing system 32 and the luminance linearization circuit 22.

In operation, the computing system may compare the signals $I_o$ and $I_c$ against ideal representations. These comparisons could be used in an iterative process wherein one or more of the parameters controlling the generation and display may be adjusted to optimize the modelling system output. For example, the computing system might instruct the grayscale processor to vary filter type, shift or re-orient the sampling grid, adjust overlap of sampling areas, etc. Linearization values may also be adjusted. In this way, the individual portions of the system may be tailored for optimal performance. For example, for a given display device, an optimal grayscale generator may be determined. Additionally, an appropriate luminance linearization for a certain display device may be determined.

A parallel output may be provided from the grayscale processor to a conventional display device. Thus, the product of the modelling system may be visually monitored and an observer of the conventional display device may actively take part in the system optimization. Similarly, the output of the luminance linearization circuit may be provided to a digital-to-video converter for display.

Figure 13:
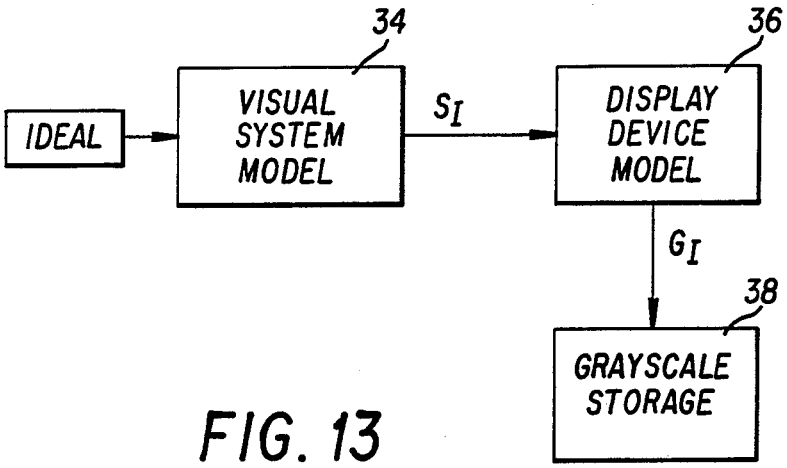
FIG. 13 schematically illustrates a system for generating grayscale characters from ideal representations of character images.

Referring now to FIG. 13, a modelling system may be used to backsolve for grayscale character images. If a representation of an ideal retinal or cortical image is available, this representation may be used in a visual system model 34 to solve for an output signal $S_I$ which when convolved with the visual system filter would match the ideal image. The output signal $S_I$ of the visual system model would then represent the ideal stimulus to the visual system.

The signal $S_I$ may then be provided to the display model 36. The signal $S_I$ would be used to solve for a signal which when convolved with the point spread function would provide the ideal stimulus signal $S_I$. The inverse of the luminance linearization function L would then be applied to determine the ideal input to the display. The output signal $G_I$ from the display device model 36 would then define the ideal grayscale character image. This ideal grayscale character image may then be stored in a grayscale storage device 38. In this way, a set of ideal grayscale character images may be developed.

In accordance with another feature of the present invention, appropriate linearization of grayscale intensity settings for accurately controlling sub-pixel positioning of image edges, such as in grayscale characters, may be determined. Furthermore, display devices may be interactively calibrated for particular users.

Figure 14:
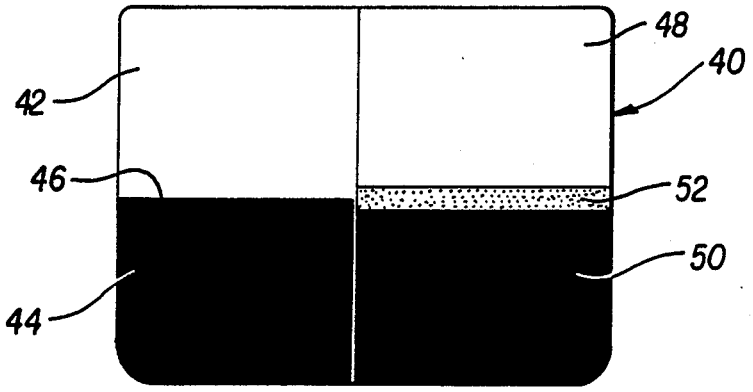
FIG. 14 illustrates a CRT screen display useful in calibrating luminance linearization for grayscale subpixel edge placement.
Figure 16:
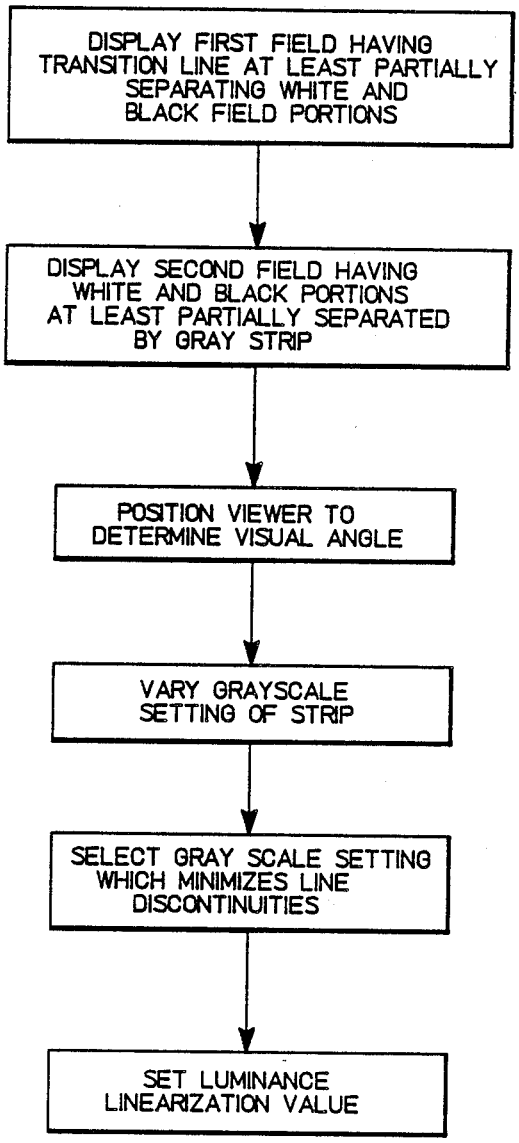
FIG. 16 illustrates the method of determining the luminance linearization values according to the present invention.
Figure 17:
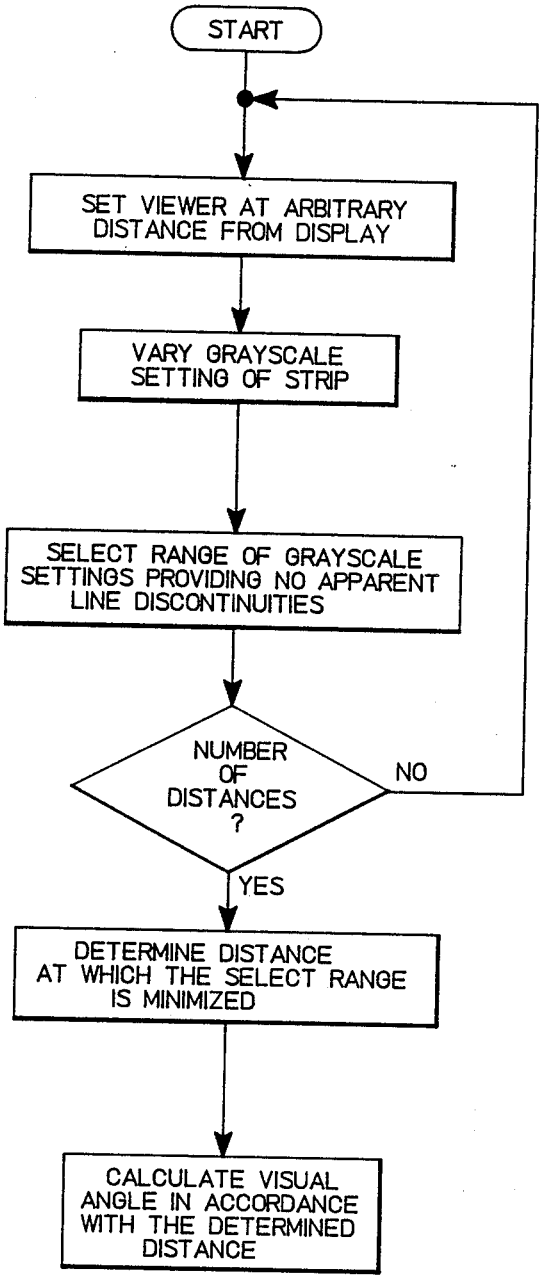
FIG. 17 illustrates the method of calculating the visual angle according to the present invention.

Referring to FIGS. 14, 16 and 17, the left half of a CRT screen 40 may be presented with a bipartite field including an upper white portion 42 and a lower black portion 44. A sharp black/white transition 46 is provided between the respective portions. The right half of the CRT screen in provided with a similar bipartite field including an upper white portion 48 and a lower black portion 50. However, instead of a sharp transition between the respective fields, an intervening strip 52 of gray pixels separates the fields on the right half of the CRT screen. It should be noted that the vertical line in FIG. 14 separating the left and right halves of the screen is merely for illustrative purposes.

The pixel height of the intervening grayscale strip 52 depends upon the desired sub-pixel image placement. For example, if a 50% sub-pixel placement is desired, two grayscale pixel rows would be included in the grayscale strip 52. For a 33% pixel placement, three pixel rows would be included, and four pixel rows would be included for a 25% sub-pixel placement, as will be discussed below in greater detail.

Prior to luminance calibration of a grayscale device, it is useful to determine the visual angle at which grayscale images first begin working. At great distances, all possible grayscale settings along a character edge would appear the same due to filtering by the visual system. At very short distances, on the other hand, an observer will always be able to delineate the gray area. At some particular visual angle, only one or a few grayscale settings will align the character image edge.

In order to determine the appropriate visual angle for a particular viewer, the viewer will be placed at a first arbitrary distance from the CRT screen and the grayscale setting of the intermediate gray strip 52 is varied over a range of settings. The range of grayscale settings at which the apparent black/white transition between white portion 48 and black portion 50 appears aligned with the sharp transition 46 is determined. The viewer is then moved to a second arbitrary distance and the range of effective grayscale settings is again determined. The distance at which the range of effective grayscale settings is minimized and the height of the gray strip determine the visual angle at which sub-pixel positioning through grayscale imaging begins working.

Once an appropriate visual angle has been determined, the luminance of a display device may be calibrated with respect to a particular user in terms of appropriate linearization of luminance values for sub-pixel edge placement. If a 50% sub-pixel edge placement is desired, the gray strip 52 will include two rows of pixels, with one row being vertically displaced above the black/white transition 46 and one row being vertically displaced below the black/white transition 46.

A viewer is set at a distance determined by the pixel height and the predetermined visual angle. The grayscale setting for the pixels of the gray area 52 is adjusted and the gray scale setting which minimizes detectability of any edge discontinuities between black/white transition 46 and the border between white portion 48 and black portion 50 is determined. This determined grayscale setting corresponds to an appropriate grayscale setting for 50% sub-pixel edge placement.

The process set forth above could then be repeated for various sub-pixel edge placements. If it was desired to determine appropriate grayscale settings for 33% edge placement, a third row of grayscale pixels may be added to the gray strip 52. In order to maintain the predetermined visual angle, the distance at which the viewer is positioned is adjusted to accommodate the increased height of the gray strip 52. Again, the grayscale intensity setting of the gray strip 52 is adjusted until edge detectability is minimized between the black/white transition 46 and the apparent border of the white portion 48 and the black portion 50. The grayscale setting which minimizes edge discontinuity determines the appropriate linearization value for 33% sub-pixel edge placement.

For a 25% sub-pixel edge placement, four rows of pixels will be used in the gray strip 52, with, for example one row of pixels vertically displaced above the black/white transition 46 and three rows of pixels vertically displaced below the black/white transition 46. After adjusting viewer position to maintain the predetermined visual angle, the luminance linearization value for 25% sub-pixel edge placement is determined. Of course, this process may be repeated for additional sub-pixel edge placements.

It is noted that the transitions between black and white portions in FIG. 14 are along a horizontal line. In this way, the display illustrated in FIG. 14 is tailored to the characteristics of a conventional CRT monitor which includes a horizontal scan direction. If the transition between the black and white portions was along a vertical line, the edge would often appear less sharp due to inherent limitations of CRT display technology.

Figure 15:
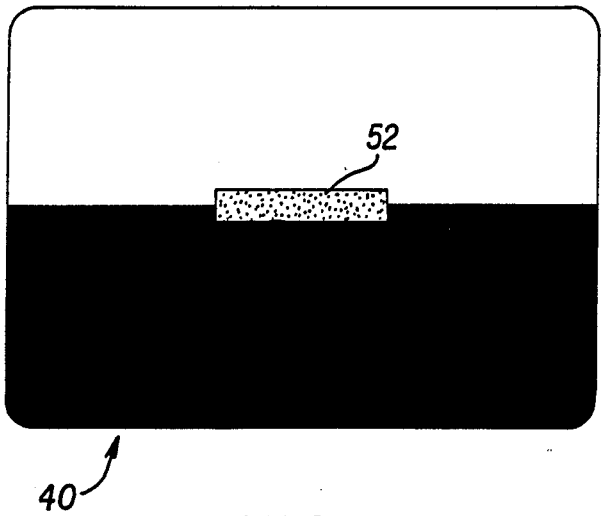
FIG. 15 illustrates a modified CRT screen display similar to that of FIG. 14.

Additionally, in order to provide two edge discontinuities, the image illustrated in FIG. 14 may be rotated to obtain the image of FIG. 15. With the provision of two possible edge discontinuities, more accurate luminance linearization settings be determined. Additionally, by centering the gray strip 52 with respect to the CRT screen, any adverse effects resulting from slight vertical displacement of the scanning beam during a horizontal scan are minimized.

The processes described above in connection with FIGS. 14 and 15 may be repeated for a number of individuals. An average grayscale image edge response may then be calculated. In turn, this average may be used to determine appropriate factory linearization settings for grayscale display devices.

Although the preceding discussion focused on CRT screen displays, the features and advantages of the present invention may likewise be applied to other appropriate grayscale display technologies.

The principles, preferred embodiments and modes of operation of the present invention have been described in the foregoing specification. The invention which is intended to be protected herein, however, is not to be construed as being limited to the particular forms disclosed, since these are to be regarded as illustrative rather than restrictive. Variations and changes may be made by those skilled in the art without departing from the spirit of the invention.

What is claimed is:

1. A method for calibrating luminance linearization values for sub-pixel edge placements in a grayscale display device, comprising the steps of:

displaying a first field on a first area of said display device, said first field having a sharp transition line separating a first white field portion and a first black field portion;

substantially concurrently displaying a second field on a second area of said display device adjacent said first area, said second field having a second white field portion and a second black field portion separated by an intermediate gray strip, said gray strip being substantially parallel with said sharp transition line and having a height corresponding to a predetermined visual angle and a vertical position relative to said sharp transition line determined by a desired sub-pixel edge placement;

positioning a viewer at a distance from said display device calculated from said gray strip height and the predetermined visual angle;

varying the grayscale setting of the gray strip;

selecting the grayscale setting which minimizes line discontinuities between said sharp transition and a transition line between said second white field portion and said second black field portion perceived by said viewer;

setting a luminance linearization value corresponding to said desired sub-pixel edge placement for said display device to the grayscale setting selected by said selecting step.

2. The method of claim 1, wherein the steps are repeated for a plurality of sub-pixel edge placements.

3. The method of claim 1, wherein said sharp transition line is generally parallel with a scan direction of said display device.

4. The method of claim 3, wherein said gray strip is centered on said display device.

5. The method of claim 1, wherein said gray strip is centered on said display device.

6. The method of claim 1, further including the step of determining said visual angle.

7. The method of claim 6, wherein said visual angle determining step includes the substeps of:

(a) setting said viewer at an arbitrary distance from said display device;

(b) varying the grayscale setting of the gray strip;

(c) selecting the range of grayscale settings which provide no apparent line discontinuities between said sharp transition and a transition line between said second white field portion and said second black field portion;

(d) repeating steps a through c for a plurality of distances from said display device;

(e) determining the distance at which the range of grayscale settings which provide no apparent line discontinuities between said sharp transition and a transition line between said second white field portion and said second black field portion is minimized;

(f) calculating visual angle in accordance with the distance determined in said determining step and the height of said gray strip.

8. The method of claim 7, wherein said white portion of said first field abuts said white portion of said second field along one edge, and wherein said black portion of said first field abuts said black portion of said second field along one edge.

9. The method of claim 1, wherein said white portion of said first field abuts said white portion of said second field along one edge, and wherein said black portion of said first field abuts said black portion of said second field along one edge.

10. The method of claim 9, wherein the steps are repeated for a plurality of sub-pixel edge placements.

11. The method of claim 9, wherein said sharp transition line is generally parallel with a scan direction of said display device.

12. The method of claim 11, wherein said gray strip is centered on said display device.

13. The method of claim 9, wherein said gray strip is centered on said display device.

14. The method of claim 1, wherein said displaying, positioning, varying, and selecting steps are repeated for a plurality of viewers, and said setting step sets a luminance linearization value in accordance with an average of the selected grayscale settings.

15. A method for setting luminance linearization values for a grayscale display device, comprising the steps of:

(a) displaying a first field on a first area of said display device, said first field having a sharp transition line separating a first white field portion and a first black field portion;

(b) substantially concurrently displaying a second field on a second area of said display device adjacent said first area, said second field having a second white field portion and a second black field portion separated by an intermediate gray strip, said gray strip being substantially parallel with said sharp transition line and having a height corresponding to a predetermined visual angle and a vertical position relative to said sharp transition line determined by a desired sub-pixel edge placement;

(c) setting a viewer at an arbitrary distance from said display device;

(d) varying the grayscale setting of the gray strip;

(e) selecting the range of grayscale settings which provide no apparent line discontinuities between said sharp transition and a transition line between said second white field portion and said second black field portion;

(f) repeating steps c through e for a plurality of distances from said display device;

(g) determining the distance at which the range of grayscale settings which provide no apparent line discontinuities between said sharp transition and a transition line between said second white field portion and said second black field portion is minimized;

(h) calculating a visual angle in accordance with the distance determined in said determining step and the height of said gray strip;

(i) repeating steps c through h for a plurality of viewers;

(j) calculating an average visual angle;

(k) positioning a viewer at a distance from said display device calculated from said gray strip height and said average visual angle;

(l) varying the grayscale setting of the gray strip;

(m) selecting the grayscale setting which minimizes line discontinuities between said sharp transition and a transition line between said second white field portion and said second black field portion apparent to said viewer;

(n) repeating steps k through m for a plurality of viewers and calculating an average grayscale setting selected by said selecting step;

(o) setting a luminance linearization value corresponding to said desired sub-pixel edge placement for said display device to said average grayscale setting.

16. The method of claim 15, wherein said white portion of said first field abuts said white portion of said second field along one edge, and wherein said black portion of said first field abuts said black portion of said second field along one edge.

17. The method of claim 15, wherein the steps are repeated for a plurality of sub-pixel edge placements.

18. The method of claim 16, wherein said sharp transition line is generally parallel with a scan direction of said display device.

19. The method of claim 18, wherein said gray strip is centered on said display device.

20. The method of claim 16, wherein said gray strip is centered on said display device.

* * * * *